US012799932B2

(12) United States Patent
Bauer et al.

(10) Patent No.: US 12,799,932 B2
(45) Date of Patent: Nov. 17, 2026

(54) CONVEYING DEVICE WITH BELLOWS AND COOLING DEVICE

(71) Applicant: Hydac Technology GmbH, Sulzbach / Saar (DE)

(72) Inventors: Frank Bauer, Marpingen (DE); Peter Kloft, Ransbach-Baumbach (DE)

(73) Assignee: HYDAC TECHNOLOGY GMBH, Sulzbach/Saar (DE)

( * ) Notice: Subject to any disclaimer, the term of this patent is extended or adjusted under 35 U.S.C. 154(b) by 0 days.

(21) Appl. No.: 18/576,085

(22) PCT Filed: Jul. 6, 2022

(86) PCT No.: PCT/EP2022/068669
§ 371 (c)(1),
(2) Date: Jan. 2, 2024

(87) PCT Pub. No.: WO2023/285219
PCT Pub. Date: Jan. 19, 2023

(65) Prior Publication Data

US 2024/0344510 A1 Oct. 17, 2024

(30) Foreign Application Priority Data

Jul. 14, 2021 (DE) ..... 10 2021 003 639.5

(51) Int. Cl.
*F04B 45/033* (2006.01)
*F04B 39/06* (2006.01)
*F04B 53/08* (2006.01)

(52) U.S. Cl.
CPC ..... *F04B 45/0333* (2013.01); *F04B 39/064* (2013.01); *F04B 53/08* (2013.01)

(58) Field of Classification Search
CPC .... F04B 43/009; F04B 43/067; F04B 43/107; F04B 39/04–048; F04B 45/0333; F04B 45/0733; F04B 45/062; F04B 53/08
See application file for complete search history.

(56) References Cited

U.S. PATENT DOCUMENTS 2,735,369 A * 2/1956 Turvey ..... F04B 43/009 92/38
4,836,756 A * 6/1989 Fukumoto ..... F04B 43/0063 417/9

(Continued)

FOREIGN PATENT DOCUMENTS

CN 110 761 989 2/2020 ..... F04B 53/14
DE 102009060852 A1 7/2011 ..... F15B 1/04

(Continued)

OTHER PUBLICATIONS

Search Report for International Application No. PCT/EP2022/068669, 6 pages, Oct. 11, 2022.

(Continued)

*Primary Examiner* — Thomas Fink
(74) *Attorney, Agent, or Firm* — Slayden Grubert Beard PLLC

(57) ABSTRACT

Conveying device, in particular in the form of a compressor, consisting of at least one housing (10) and a partition element which is arranged movably in the housing (10) and separates two fluid regions (14, 16) in the housing (10) from each other, wherein the partition element is formed of a partition bellows (18) with individual bellows folds (20), wherein a mechanical actuation device for controlling a movement of the partition bellows (18) is provided, and wherein the heat generated by means of the actuation device via the movement of the partition bellows (18) can be at least partially removed from the housing (10) by means of a cooling device.

23 Claims, 2 Drawing Sheets

(56) References Cited

U.S. PATENT DOCUMENTS

| | | | | |
|---|---|---|---|---|
| 2007/0224058 | A1* | 9/2007 | Haseley | F04B 35/045 417/415 |
| 2012/0211110 | A1 | 8/2012 | Baltes | 138/30 |
| 2014/0318115 | A1 | 10/2014 | Schulz | 60/414 |
| 2015/0013333 | A1* | 1/2015 | Eggler | F04B 43/0054 60/618 |
| 2016/0123313 | A1* | 5/2016 | Simmons | F04B 9/133 417/392 |
| 2019/0032685 | A1* | 1/2019 | Foster | F15B 15/10 |
| 2019/0383280 | A1 | 12/2019 | Simmons | F04B 43/025 |
| 2021/0164455 | A1* | 6/2021 | Hillebrand | F04B 9/1178 |
| 2022/0375630 | A1* | 11/2022 | Chrobak | G21B 1/15 |
| 2024/0376888 | A1* | 11/2024 | Clyburn | F04B 51/00 |

FOREIGN PATENT DOCUMENTS

| | | | | |
|---|---|---|---|---|
| DE | 10 2018 001 523 | | 8/2019 | F01N 3/10 |
| EP | 3 078 856 | | 10/2016 | F04B 43/08 |
| EP | 3 578 820 | | 12/2019 | F04B 43/08 |
| RU | 2685353 | C1 * | 4/2019 | F04B 43/0054 |
| WO | WO-0208607 | A1 * | 1/2002 | F04B 43/107 |
| WO | 2013 079222 | | 6/2013 | F15B 21/14 |
| WO | 2015 078487 | | 6/2015 | F04B 43/00 |
| WO | WO-2015078487 | A1 * | 6/2015 | F04B 43/0054 |

OTHER PUBLICATIONS

International Preliminary Report on Patentability, Application No. PCT/EP2022/068669, 6 pages, Jan. 25, 2024.

* cited by examiner

CONVEYING DEVICE WITH BELLOWS AND COOLING DEVICE

CROSS-REFERENCE TO RELATED APPLICATIONS

This application claims priority to German Patent Application No. DE 10 2021 003 639.5, filed on Jul. 14, 2021 with the German Patent and Trademark Office. The contents of the aforesaid Patent Application are incorporated herein for all purposes.

BACKGROUND

This background section is provided for the purpose of generally describing the context of the disclosure. Work of the presently named inventor(s), to the extent the work is described in this background section, as well as aspects of the description that may not otherwise qualify as prior art at the time of filing, are neither expressly nor impliedly admitted as prior art against the present disclosure.

The disclosure relates to a conveying device, in particular in the form of a compressor, consisting of at least one housing and a separating element arranged movably in the housing and separating two fluid regions in the housing from each other.

WO 2013/079222 A2 discloses a conveying device for improving the energy efficiency in hydraulic systems, having an actuator which in one operating state operates as a consumer of hydraulic energy and in another operating state operates as a producer of hydraulic energy, and having a hydraulic accumulator which in the one operating state of the actuator can be charged by said actuator for energy storage and in the other operating state can be discharged for delivering energy to the actuator. A discontinuously adjustable hydropneumatic piston accumulator, in which a plurality of pressure chambers are formed that are adjacent to differently sized effective areas on the fluid side of the accumulator piston, serves as the hydraulic accumulator. In addition, an actuating arrangement is provided which, depending on the respective pressure levels prevailing on the gas side of the piston accumulator and at the actuator, connects a selected pressure chamber or a plurality of selected pressure chambers of the piston accumulator to the actuator.

This results in the possibility of delivering energy independently of the precharge pressure on the gas side of the accumulator and independently of the respective load pressure because, by selecting an effective area of suitable size, the respective desired pressure level at the accumulator can be used for charging or discharging. This enables optimum energy conversion in all operating states. The known multi-piston arrangement for the piston accumulator requires seals, such as metallic piston rings or rubbery-elastic plastic seals, to seal the individual piston chambers against each other. Due to the high forces and pressures which occur during operation, it is usually also necessary to additionally use lubricants to keep the friction forces as low as possible so as thus to reduce wear and create a seal that is as leak-free as possible. Nevertheless, leaks cannot be avoided and friction causes wear on both the individual pistons and the associated sealing material. Although these wear particles are usually small, they nevertheless lead to contamination of the gases or liquids to be conveyed, some of which can also be of high purity, which can then in turn only be remedied by very elaborate filtering measures in the fluid flow. Insofar as heat is introduced on the gas side of the conveying device with a predefinable enclosed gas quantity due to friction during operation of the conveying device, the excess heat can be dissipated from the housing of the conveying device via the quantities of liquid passing through on the fluid side so that there is no additional damaging effect due to undesirable input of heat into the conveying device.

SUMMARY

A need exists to provide an improved conveying device which also enables compressor operation with gases such as hydrogen.

The need is addressed by the subject matter of the independent claim(s). Embodiments of the invention are described in the dependent claims, the following description, and the drawings.

DESCRIPTION

Figure 1:
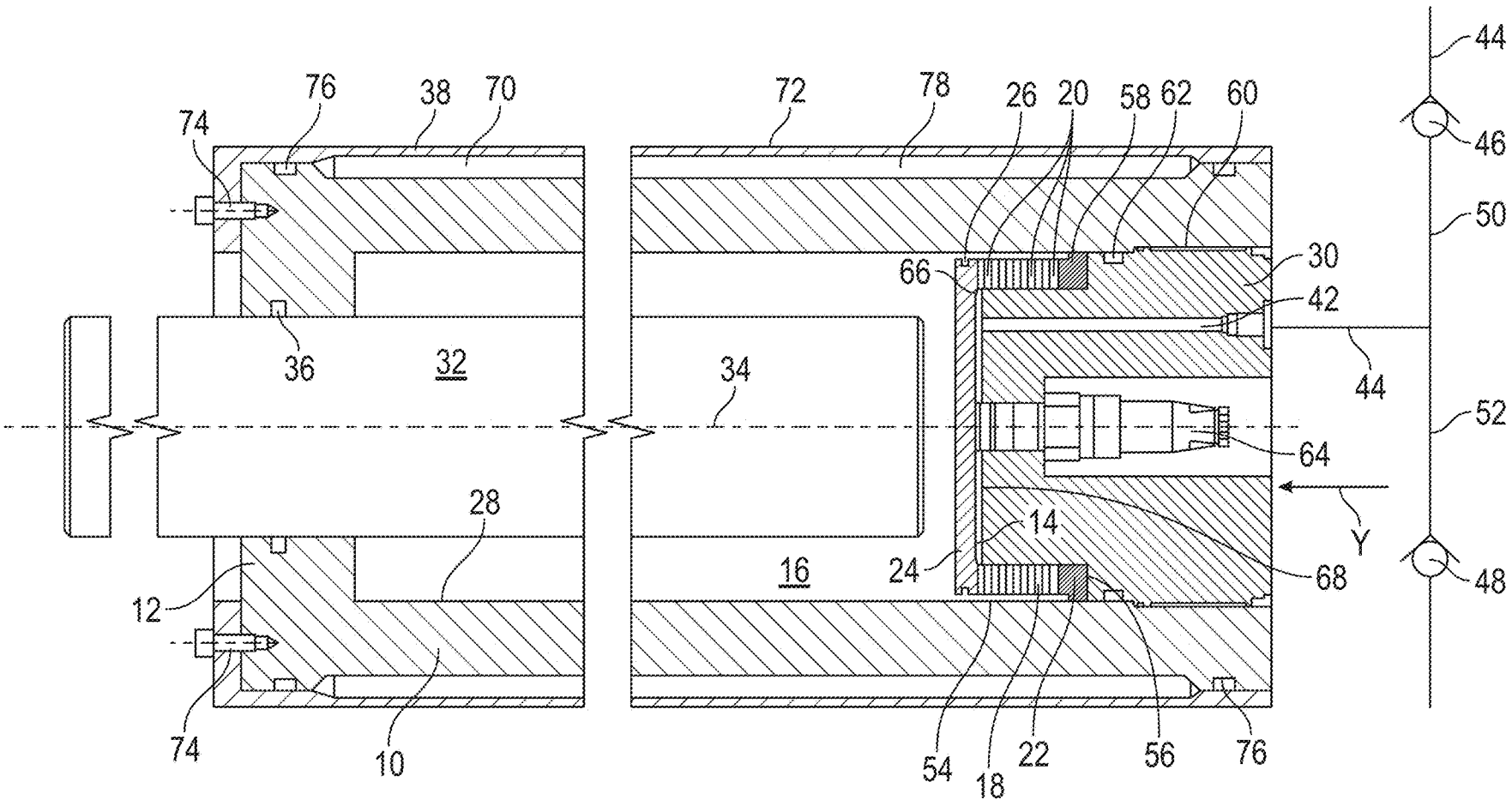
FIG. 1 shows main components of an example conveying device in the manner of a longitudinal section along the line X-X in FIG. 2.

The details of one or more embodiments are set forth in the accompanying drawings and the description below. Other features will be apparent from the description, drawings, and from the claims.

In the following description of embodiments of the invention, specific details are described in order to provide a thorough understanding of the invention. However, it will be apparent to one of ordinary skill in the art that the invention may be practiced without these specific details. In other instances, well-known features have not been described in detail to avoid unnecessarily complicating the instant description.

Since in some embodiments, the separating element is formed of a separating bellows with individual bellows folds, a mechanical actuating device is provided for controlling a movement of the separating bellows, and the heat generated by means of the actuating device via the movement of the separating bellows can be at least partially dissipated from the housing by means of a cooling device, this ensures in any case that no more leakages can occur. The separating bellows with its individual bellows folds creates a media-tight, in particular also gas-tight, separation between the two fluid regions in the housing so that any particles entering also cannot be unintentionally exchanged between the fluid regions. In this respect, the separating bellows can be described as media-tight so that the conveying device can also be used as a compressor for gases, such as hydrogen gas.

If the separating bellows or bellows is extended, the volume of the one fluid region is increased and the fluid to be conveyed flows into the one fluid region, whereas the volume of the other fluid region inevitably decreases at the same time. Conversely, on contracting the separating bellows, the volume of the other fluid region increases while the one fluid region simultaneously decreases, and the conveying volume previously taken up in this one fluid region in the intake stroke is discharged from the conveying device in the course of a single delivery stroke under the pressure effect of the contracting separating bellows. The separating bellows is for example extended by the conveying volume flowing in on the inlet side of the housing with predefinable pressure from a fluidic supply circuit to which the conveying device is connected in a fluid-conducting manner.

The separating bellows is contracted, on the other hand, under the action of a mechanical actuating device which controls the separating bellows in such a manner that the fluid volume previously taken up in the one fluid region is expelled under pressure from the housing into the fluidic supply circuit, with the supply of downstream fluid towards the one fluid region being prevented.

However, there is also the possibility of coupling the separating bellows to the mechanical actuating device in such a manner that it exclusively or at least predominantly causes both the extending and contracting movement for the separating bellows. Due to the mechanical actuating device, movement processes for movement of the separating bellows can be initiated therein in rapid succession; in contrast to the prior art in which more or less large quantities of liquid always have to first control a piston drive for conveying the fluid, which quantities of liquid always have to first be brought in or out, in relation to the housing, with the movable pistons. In this way, the conveying device can be used for transporting flowable fluids in associated supply circuits. Thus, in addition to pure liquids, it is also possible to transport gases or gas/liquid mixtures.

In recent times, the use of hydrogen as an energy source has thus become increasingly important. To keep the volume of hydrogen to be conveyed low, it can be useful not only to convey the hydrogen in a connected supply circuit but also to compress or condense it to higher pressure levels during a conveying step. In this way, the volume to be conveyed can be reduced and hydrogen can be made available at high pressure for the targeted later use.

However, similar to other gases too, condensing hydrogen results in a significant rise in temperature which, on the one hand, counteracts the targeted compression due to the associated expansion of the gas and, on the other hand, this unwanted input of heat can impair the function of or even damage the mechanical components of the conveying device which may include any remaining, necessary sealing systems.

In any case, the separating bellows, for example made of stainless steel, is suitable as a reliable media-separating device to prevent undesirable particulate contamination, in particular arising from the mechanical actuating device, from reaching the gas side of the conveying device. In particular when the hydrogen is used in the course of fuel cell operation, there must be no particulate contamination in the gas flow. Furthermore, the stainless-steel separating bellows is suitable to effectively counteract any embrittlement caused by the possibly very cold hydrogen gas. This thus has no equivalent in prior art.

In some embodiments, it is provided that the actuating device comprises a drivable actuating rod which at least partially passes through the housing and can be brought into contact with a bellows base of the separating bellows for controlling a movement of the separating bellows. The actuating rod of the actuating device can be hydraulically controlled, for example by using a hydraulic working cylinder or, if necessary, by engaging a suitable intermediate gear, by means of an electric motor which can be operated in both directions. The actuating rod can be designed to be solid and is capable of transmitting high actuating forces to the separating bellows to be moved.

In some embodiments, it is provided that the bellows base of the separating bellows can be controlled on its side opposing the actuating rod by a fluid pressure which, penetrating the one fluid region, results in the separating bellows being extended and to the actuating rod, which is kept at least partially free of forces in this respect, being moved back. In this way, the separating bellows can be controlled by the pressure medium to be conveyed for an extending or filling procedure, whereas the actuating rod acting pressure-actively on the opposing side for a delivery stroke causes the bellows to contract in a volume-reducing manner while reducing the volume in the one fluid region of the housing. The actuating processes to this effect take place one after the other in alternating sequence, it being possible to move the separating bellows from the intake stroke to the delivery stroke and back again in rapid succession. In particular with a working gas to be transported, such as hydrogen gas, high compression ratios can then be achieved via the conveying device by means of the separating bellows, so that to this extent the conveying device can also be operated as a compressor with conveying function.

In some embodiments, it is provided that the fluid volume enclosed in the other fluid region remains the same or substantially the same when the separating bellows are extended by moving the actuating rod back out of this other fluid region in order to prevent disruptions in operation when the bellows is expanded. As the bellows is expanded, a volume of air is displaced In the other fluid region, the actuating rod retracting to the same extent that the bellows is expanded and at the same time partially extending out of the housing of the conveying device so that additional free volume is created in the other fluid region, into which the separating bellows can displace air, so that unrestricted operation is enabled, despite the enclosed volume of air in the further fluid region of the conveying device.

In some embodiments, it is provided that a bellows retainer is arranged inside the housing in such a manner that, with the bellows base bearing on the bellows retainer, the bellows folds, for example abutting against each other are stacked in a receiving space between the bellows retainer and the housing. As the separating bellows with its bellows folds is susceptible to buckling and bulging stresses, secure fold guidance is achieved in this way via the receiving space and, in particular, it is ensured that in the contracted state of the separating bellows the individual folds cannot buckle or bulge until they are abutting against each other. Furthermore, in this manner a space-saving receptacle for the bellows folds is achieved in the housing of the conveying device. If the separating bellows with its bellows folds is completely stacked in the receiving space, the bellows base lies flat on the bellows retainer at least on the inside and facing towards the bellows retainer, at least in a circular edge region, so that a secure, buckling-resistant support is also achieved in this respect and the free, changing fluid volume for the one fluid region of the conveying device is zero or almost zero on the maximum delivery stroke.

If the separating bellows extends during an intake stroke, the bellows base can rest on its one free end face on the free end-face-side end of the actuating rod which in this respect ensures that the bellows folds cannot be undesirably over-expanded, which could otherwise lead to the bellows becoming unusable.

At least one fluid line which opens into the one fluid region is for example arranged in the bellows retainer. The intake stroke for the fluid volume to be conveyed as well as the discharge or delivery stroke for this volume from the one fluid region of the conveying device takes place via the respective fluid line.

A proximity sensor, for example in the form of a proximity switch, is for example provided in the bellows retainer for monitoring the position of the separating bellows, which sensor, when actuated, can control the expansion movement of the actuating rod so that the separating bellows again performs an extension movement under fluidic control.

In some embodiments, it is provided that the housing has parts of the cooling device on the outer circumference or these are an integral part of the housing. The parts of the cooling device consist substantially of a fluid guide for the cooling medium or a receiving option for this purpose on the circumference of the housing of the conveying device. Thus, the parts of the cooling device mentioned can consist of a cooling coil which is placed around the outer circumference of the housing and through which cold cooling medium coming from a central cooling supply can be introduced on the input side for cooling and the cooling medium heated by the operation of the conveying device can be discharged on the output side to the central cooling supply point.

In some embodiments, it is provided that the cooling device has a cooling chamber through which a cooling medium flows, which cooling chamber arranged concentrically at least partially encompasses the housing on the outer circumference. Beneficially, it is further provided that the cooling chamber is bounded by the housing and an additional housing part which together with the housing constitutes a tradeable structural unit. Alternatively, a plurality of individual cooling chambers can also be arranged on the outer circumference on the housing of the conveying device, or the housing is provided with cooling fins which are for example blown at from the outside via a fan device for the purpose of heat dissipation from the housing. In addition, to implement a cooling device, it is also possible to install cooling ducts directly in the housing of the conveying device through which cooling ducts a cooling medium can correspondingly flow from the cooling supply.

The conveying device according to the invention is explained in greater detail below with reference to drawings. The drawings show in principle and not to scale. Specific references to components, process steps, and other elements are not intended to be limiting. Further, it is understood that like parts bear the same or similar reference numerals when referring to alternate FIGS.

The conveying device shown in FIG. 1 has a pot-shaped housing 10 with a housing base 12. A separating bellows 18 is arranged in the, for example, hollow cylindrical housing 10 as a separating element which separates two fluid regions 14, 16 from each other in the housing 10.

The separating bellows 18 has, in the usual manner, a plurality of individual, interconnected bellows folds 20 which, according to the embodiment shown in FIG. 1, abut one another in succession when moved up. Such separating bellows systems are known in particular from bellows accumulators as a subgroup of hydraulic accumulators, as shown by way of example in DE 10 2009 060 852 A1, incorporated herein by reference. The last bellows fold 20 in the stacking sequence on a free end face is welded to a retaining ring 22 and the opposing other bellows fold 20 is welded to a bellows base 24 on the in this respect further free end face. The bellows base 24 is configured as a flat end plate and has an annular groove 26 on the outer circumference for receiving a sealing and/or guide ring, not shown in greater detail, via which the bellows base 24 is guided so as to be longitudinally movable along the inner circumference 28 of the housing 10.

According to the embodiment shown in FIG. 1, the bellows base 24 spans a bellows retainer 30 which is designed as a screw-in part and is screwed in flush on the free end of the housing pot which is open towards one side. On the opposing side of the bellows base 24 and held at an axial distance, there is an actuating rod 32 as part of a mechanical actuating device. The actuating rod 32 can be moved back and forth over a predefinable distance via an actuator device, not shown in greater detail, for example in the form of a hydraulic working cylinder. Furthermore, the actuating rod 32, viewed concentrically with respect to the longitudinal axis 34 of the housing 10, passes through the in this respect otherwise closed housing base 12. A further annular groove 36 is introduced into the housing base 12 for the purpose of receiving a guide and/or sealing device (not shown) to seal the interior of the housing 10 in the form of the further fluid region 16 from the environment in any travel position of the actuating rod 32. This further fluid region 16 is for example filled with air; however, another filling gas, such as nitrogen gas, may also be introduced if necessary. In addition, parts 38 of a cooling device denoted as a whole by 40 (FIG. 3) are attached to the outer circumference of the housing 10, which will be discussed in greater detail below.

As can further be seen from FIG. 1, the bellows retainer 30 is penetrated by a duct-like fluid line 42 which with its one free end opens into the one fluid region 14 and with its other free end is connected via a corresponding connection point to a customary fluid supply circuit 44 which should conform to customary prior art. Two check valves 46, 48, for example of the same design, are connected in the relevant circuit 44, which valves can also be held in their shown closed position under spring load if necessary. In this case, the check valve 46 associated with a fluid inlet 50 and the check valve 48 is associated with a fluid outlet 52. Both inlet 50 and outlet 52 are part of a T-shaped connection piece which opens into the fluid line 42 in the bellows retainer 30.

Figure 2:
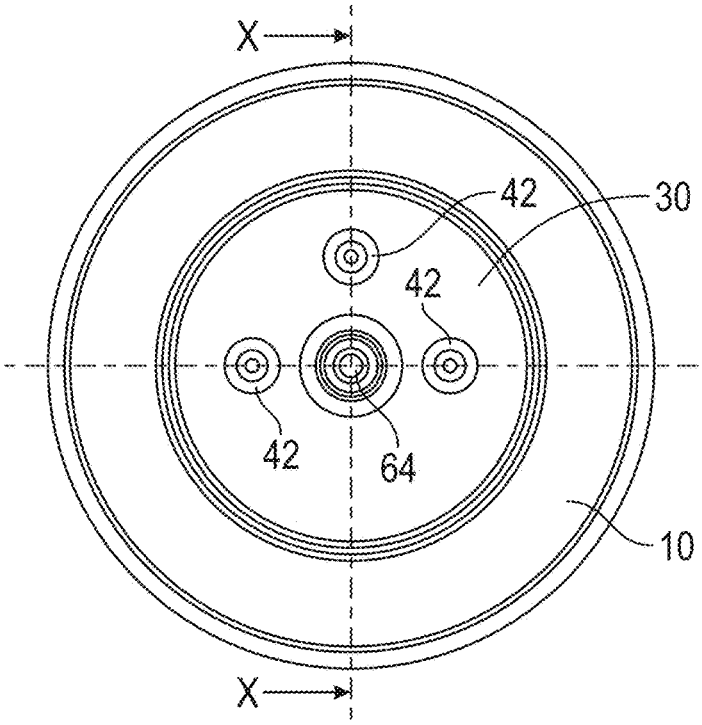
FIG. 2 shows an end face view of the example conveying device in the direction of arrow Y according to FIG. 1.

As the diagram according to FIG. 2 shows, a plurality of, in the present case, three fluid lines 42 can be arranged in the bellows retainer 30 so that both during inflow and outflow of fluid via the one fluid region 14, the bellows base 24 is uniformly pressurised on its inner side, for example during an incoming flow or outgoing flow process. In this respect, too, the further two fluid lines 42 are to be connected to the supply circuit 44 via a corresponding line guidance. In an embodiment not shown in greater detail, however, there is also the option to separate the inlet 50 with check valve 46, which opens towards the one fluid region 14, from the outlet 52 via an independent fluid line 42 in the bellows retainer 30, the check valve 48 to this end opening in the opposite direction to the check valve 46 as in the present case. In this way, the one fluid region 14 is then provided with an independent inlet and an independent outlet via fluid paths independent from each other. The third fluid line 42 indicated in FIG. 3 can then be omitted accordingly. For example, however, in each case the respective fluid line 42 forms a group with equal spacing around the longitudinal axis 34 of the housing 10 for space-saving accommodation and furthermore the individual fluid lines 42 assume the same radial spacing among each other (FIG. 2).

If fluid under pressure is now introduced, with the check valve 46 open, into the one fluid region 14 via the inlet 50 and the associated fluid line 42 shown, the bellows base 24 is pressurised to this extent and performs an extension movement during which the individual bellows folds 20 are pulled apart. In this respect, the bellows base 24 moves from right to left, viewed in the direction of FIG. 1, and comes into contact with the free end face of the actuating rod 32 after a predefinable travel path. The actuating rod 32 can then be locked in place and in this respect form a limit stop for the bellows base 24; however, there is also the option for the actuating rod 32 to be carried along to the left by the bellows base 24, with the actuating rod 32 being pushed out of the further fluid region 16 of the housing 10 with as little force as possible. However, it is also possible (not shown) that the actuating rod 32 bears against the bellows base 24 from the outset and to this extent they together perform the displacement movement to the left during the extension movement of the separating bellows 18. During this intake stroke, the check valve 48 in the outlet 52 remains closed so that fluid that has already been conveyed cannot flow back out of the supply circuit 44 unintentionally.

According to the embodiment shown in FIG. 1, the bellows folds 20 which are susceptible to buckling and bulging, are accommodated in an annular receiving space 54 which is bounded towards the inside by an annular shoulder 56 of the bellows retainer 30 and towards the outside by the inner circumferential side 28 or inner wall of the housing 10. Since the bellows base 24 is likewise guided on the inner circumferential side 28 of the housing 10, there is no unwanted bulging or buckling of the bellows folds 20 even when the bellows is extended, which in this respect are still guided, at the foot end in the region of the retaining ring 22, in a stabilising manner in the receiving space 54 even when the separating bellows 18 is fully extended. The retaining ring 22 rests with its one free end face on the annular shoulder 56 in the bellows retainer 30, and on the outer circumference with its other free end against a protrusion 58 on the inner circumferential side 28 of the housing 10. In this way, the separating bellows 18 with its retaining ring 22 can be placed loosely on the shoulder 56 of the bellows retainer 30 for an assembly operation and, together with the latter, can be brought into position on the protrusion 58 of the housing 10 via the threaded section 60 as part of a screw-in operation. A further third annular groove 62 is present between the bearing of the retaining ring 22 and the threaded section 60 for receiving a sealing ring, not shown in greater detail, for the purpose of sealing the one fluid region 14 from the environment of the housing 10.

To return the separating bellows 18 to its initial or home position shown in FIG. 1 when the volume of fluid in the one fluid region 14 is at a minimum, the actuating rod 32 is in contact with the bellows base 24 and has moved it back to its initial position shown by power actuation. During this power-actuated displacement movement of the bellows base 24 from left to right, the fluid volume previously stored in the one fluid region 14 on the intake stroke while closing the check valve 46 is consequently discharged from the conveying device under pressure via the outlet 52 with the check valve 48 open. If the conveying volume if a gas, such as hydrogen gas, it is compressed to a higher pressure level during the relevant delivery stroke movement. Thus it is conceivable, for example, that in the course of a stepwise pressure increase, three of the conveying devices shown in FIG. 1 form in succession a 3-stage overall compressor with which it is readily possible to raise hydrogen gas with an inlet pressure of 15 bar to a pressure level of 500 to 600 bar at the last compressor stage for further use.

In an embodiment not shown, there is also the option of firmly connecting the actuating rod 32 directly to the bellows base 24 and having both the intake stroke and the delivery stroke performed by the actuating rod 32 as part of the mechanical actuating device. As can further be seen from FIG. 1, a proximity sensor in the form of a proximity switch 64 is arranged concentrically to the longitudinal axis 34 of the housing 10 in the centre of the bellows retainer 30, said proximity switch being able to monitor the position of the bellows base 24 or, respectively, the functional state of the separating bellows 18 concomitant therewith. The relevant position monitoring is necessary so that the actuating rod 32 can be sensibly controlled by a central control device, not shown in greater detail, in particular for performing the delivery stroke. The inner side of the bellows base 24 rests in the outer circumferential edge region 66 on an associated protruding annular surface of the bellows retainer 30, a small trough-like indentation 68 being introduced within this annular contact surface on the end face in the bellows retainer 30, in which indentation the residual fluid remains, so that during the extension movement of the separating bellows 18 no vacuum can develop between the associated wall parts of the bellows base 24 and the bellows retainer 30 which could impair the extension process.

The outer wall of the cylindrical housing has a circumferential wall recess 70 which is overlapped on the outer circumference by a thin-walled cylindrical housing part 72 which is part of a housing pot that is screwed on the base side to the housing base 12 by means of a screw connection 74. Furthermore, the housing part 72 protrudes beyond the wall recess 70 on both sides and in the region of this overhang a further fourth recess 76 is present in each case in the wall of the housing 10 which recess serves to receive a ring seal, not shown, and which in this respect then seals off a cooling chamber 78 from the environment, which cooling chamber is bounded in this respect by the housing 10 and the housing part 72. This cooling chamber 78 is part of a cooling unit denoted as a whole by 40, as shown in greater detail in FIG. 3.

Figure 3:
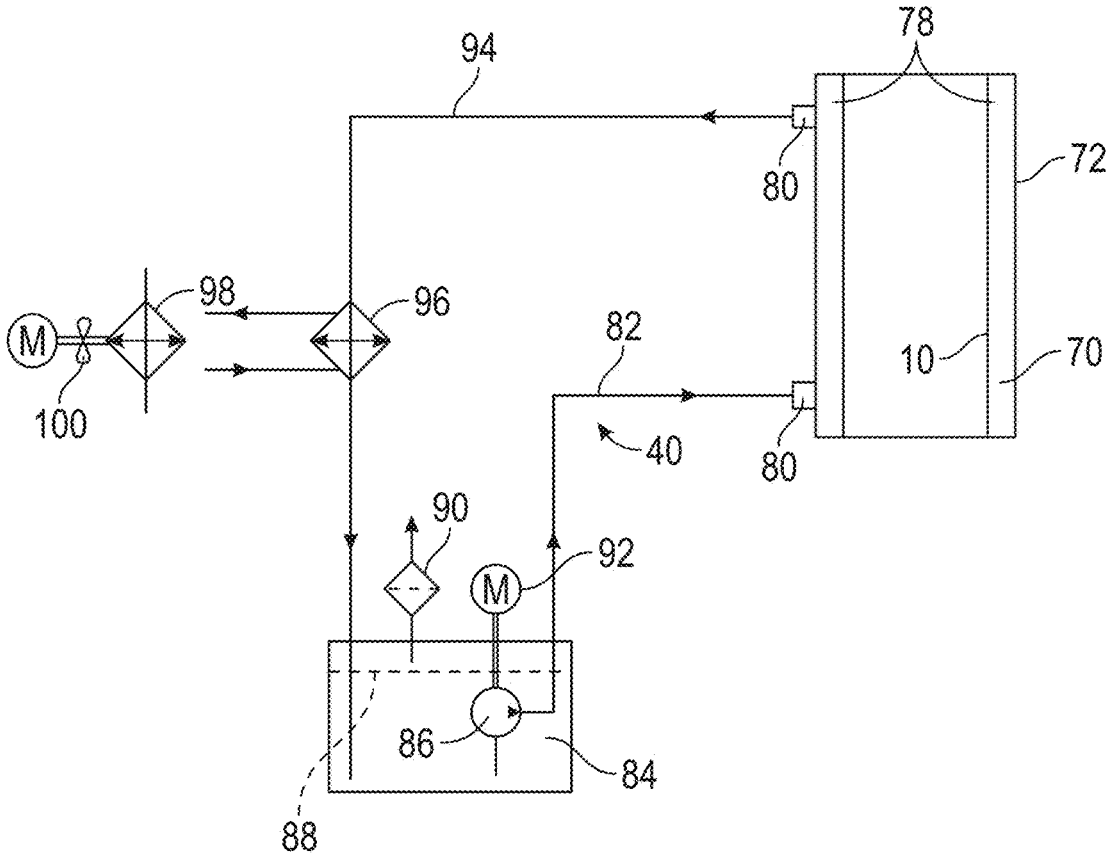
FIG. 3 main components of an example cooling supply for cooling the conveying device according to FIGS. 1 and 2.

Viewed in the direction of FIG. 3, the conveying device according to FIGS. 1 and 2 is shown only schematically in the upper right-hand corner with the housing 10 and the housing part 72 arranged above it as well as the cooling chamber 78 situated therebetween, which is connected to a cooling circuit 82 of the cooling device 40 via two fluid connection points 80. The cooling device 40 forms a type of semi-closed cooling circuit 82, for which purpose a storage tank 84 is sealed off from the atmosphere except for a specially configured aeration and ventilation device. The presence of the storage tank 84 opens up the possibility of using a submersible pump 86 as the supply pump, with its pump inlet submerged below the fluid level 88 of the storage tank 84. The aeration and ventilation device mentioned is provided on a breather filter 90 and is formed by a valve, not shown in greater detail, which opens outwards at a predetermined internal tank pressure and inwards at a predetermined negative tank pressure.

The submersible pump 86 is driven by an electric motor 92 and the submersible pump 86 in operation conveys a cooling medium in the direction of the arrows as part of the cooling circuit 82 via a flow line to the consumer, here in the form of the cooling chamber 78 for the conveying device.

Conventional coolants can be used as the cooling medium; in this specific case, a water-glycol mixture is used. The heat of compression generated by the conveying device, particularly in the context of its compressor characteristic, is introduced into the cooling chamber 78 containing the cooling medium via the interior of the separating bellows 18 and the housing 10. In the process, it is heated and returned to the tank 84 via a return line 94 and a heat exchanger 96 or 98. The heat exchanger may be a plate-type heat exchanger 96, in which heat exchange to the cooling medium takes place by means of a liquid cooling medium, or a finned cooler 98 which is cooled by cooling air by means of a motor-operated fan 100. The cooling device 40 shown in FIG. 3 is only exemplary and of course other suitable cooling devices can be used here, for example those with completely closed or open cooling circuit guidance.

It is still within the scope of the invention to replace the cooling chamber 78 shown with a cooling coil which is routed around the housing 10 of the conveying device on the outer circumference. In this respect, the connection points 80 then form the fluid inlet and fluid outlet, respectively, of the coil for cooling media guidance. The cooling chamber 78 which runs around the housing 10 like a jacket can also be subdivided into subsegments, or cooling ducts to be supplied accordingly are introduced into the housing 10 itself (not shown).

The invention has been described in the preceding using various exemplary embodiments. Other variations to the disclosed embodiments may be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. A single processor, module, device, or other unit or device may fulfill the functions of several items recited in the claims.

The term "exemplary" used throughout the specification means "serving as an example, instance, or exemplification" and does not mean "preferred" or "having advantages" over other embodiments. The terms "in particular" and "particularly" used throughout the specification means "for example" or "for instance".

The mere fact that certain measures are recited in mutually different dependent claims or embodiments does not indicate that a combination of these measures cannot be used to advantage. Any reference signs in the claims should not be construed as limiting the scope.

What is claimed is:

1. A conveying device, comprising:

a housing;

a separating element which is arranged movably in an axial direction in the housing and separates two fluid regions in the housing from each other; and a cooling device; wherein the separating element is formed of a separating bellows with individual bellows folds and a bellows base, the separating bellows moving in the axial direction from a contracted position to an extended position defining an extended length;

a mechanical actuating device is provided for controlling a movement of the separating bellows; and wherein the heat generated by the mechanical actuating device via the movement of the separating bellows is at least partially dissipated from the housing using the cooling device; wherein the mechanical actuating device comprises a drivable actuating rod which at least partially passes through the housing and can be brought into contact with the bellows base of the separating bellows for controlling a movement of the separating bellows in the axial direction; wherein the drivable actuating rod is separate from the bellows base and can selectively be held at a distance to the bellows base during conveying movement of the separating bellows; wherein the drivable actuating rod and the bellows are located on opposite sides of the bellows base; and wherein the cooling device comprises a cooling chamber extending circumferentially around the housing and extending in the axial direction to at least surround the extended length of the separating bellows.

2. The conveying device of claim 1, wherein a fluid volume enclosed in a first of the two fluid regions remains the same or substantially the same when the separating bellows is extended by moving the actuating rod back out of the first fluid region.

3. The conveying device of claim 1, wherein a bellows retainer is arranged inside the housing in such a manner that, with the bellows base bearing on the bellows retainer, the bellows folds are stacked in a receiving space between the bellows retainer and the housing.

4. The conveying device of claim 1, wherein at least one fluid line is arranged in a bellows retainer, which fluid line opens into a first of the two fluid regions.

5. The conveying device of claim 1, wherein a proximity sensor is arranged in a bellows retainer for monitoring at least one position of the separating bellows.

6. The conveying device of claim 1, wherein the housing comprises parts of the cooling device on an outer circumference or the parts of the cooling device are an integral part of the housing.

7. The conveying device of claim 1, wherein the cooling device has a cooling chamber through which a cooling medium flows which cooling chamber arranged concentrically at least partially encompasses the housing on an outer circumference.

8. The conveying device of claim 1, wherein a cooling chamber is bounded by the housing and an additional housing part which together with the housing constitutes a tradeable structural unit.

9. The conveying device of claim 2, wherein a bellows retainer is arranged inside the housing in such a manner that, with the bellows base bearing on the bellows retainer, the bellows folds are stacked in a receiving space between the bellows retainer and the housing.

10. The conveying device of claim 2, wherein at least one fluid line is arranged in a bellows retainer, which fluid line opens into a first of the two fluid regions.

11. The conveying device of claim 3, wherein at least one fluid line is arranged in the bellows retainer, which fluid line opens into a first of the two fluid regions.

12. A conveying device, comprising a cylindrical housing and a separating element which is arranged movably in the cylindrical housing and separates two fluid regions in the cylindrical housing from each other; wherein the separating element is formed of a separating bellows with individual bellows folds, the separating bellows moving in the axial direction from a contracted position to an extended position defining an extended length;

a mechanical actuating device is provided for controlling a movement of the separating bellows;

the conveying device comprising a cooling device; and the heat generated by the actuating device and the movement of the separating bellows is at least partially dissipated from the housing using the cooling device; wherein at least a part of the cooling device is arranged on an outer circumference of the cylindrical housing;

the cooling device has a cooling chamber through which a cooling medium flows, wherein the cooling chamber is arranged concentrically and at least partially encompasses the at least one cylindrical housing on the outer circumference, extending in the axial direction to at least surround the extended length of the separating bellows; wherein the cooling chamber is formed as a wall recess in an outer wall of the cylindrical housing, which wall recess is overlapped by a thin-walled cylindrical housing part to form the cooling chamber, which thin-walled cylindrical housing part is thinner than the outer wall of the cylindrical housing; and wherein the thin-walled cylindrical housing part is attached to the outer circumference of the at least one cylindrical housing to form a tradeable structural unit.

13. The conveying device of claim 12, wherein a bellows base of the separating bellows can be controlled on its side opposing the actuating rod by a fluid pressure which, penetrating a first of the two fluid regions, results in the separating bellows being extended and the actuating rod being moved back.

14. The conveying device of claim 12, wherein a fluid volume enclosed in a first of the two fluid regions remains the same or substantially the same when the separating bellows is extended by moving the actuating rod back out of the first fluid region.

15. The conveying device of claim 12, wherein a bellows retainer is arranged inside the housing in such a manner that, with a bellows base bearing on the bellows retainer, the bellows folds are stacked in a receiving space between the bellows retainer and the housing.

16. The conveying device of claim 12, wherein at least one fluid line is arranged in a bellows retainer, which fluid line opens into a first of the two fluid regions.

17. A conveying device, comprising a housing and a separating element which is arranged movably in the housing and separates two fluid regions in the housing from each other; wherein the separating element is formed of a separating bellows with individual bellows folds and a bellows base, the separating bellows moving in the axial direction from a contracted position to an extended position defining an extended length;

a mechanical actuating device is provided for controlling a movement of the separating bellows;

the conveying device comprising a cooling device; and the heat generated by the actuating device and the movement of the separating bellows can be at least partially dissipated from the housing using the cooling device; wherein the actuating device comprises a drivable actuating rod which at least partially passes through the housing and can be brought into contact with the bellows base of the separating bellows for controlling a movement of the separating bellows;

the cooling device comprises a cooling chamber extending circumferentially around the housing and extending in the axial direction to at least surround the extended length of the separating bellows;

the drivable actuating rod is separate from the bellows base and can selectively be held at a distance to the bellows base during conveying movement of the separating bellows; and wherein when the rod moves into the housing, the bellows is compressed.

18. A conveying device, comprising a housing and a separating element which is arranged movably in the housing and separates two fluid regions in the housing from each other; wherein the separating element is formed of a separating bellows with individual bellows folds and a bellows base, the separating bellows moving in the axial direction from a contracted position to an extended position defining an extended length;

a mechanical actuating device is provided for controlling a movement of the separating bellows;

the conveying device comprising a cooling device; and the heat generated by the actuating device and the movement of the separating bellows is at least partially dissipated from the housing using a cooling device; wherein the actuating device comprises a drivable actuating rod which at least partially passes through the housing and can be brought into contact with the bellows base of the separating bellows for controlling a movement of the separating bellows; wherein the drivable actuating rod is separate from the bellows base and can selectively be held at a distance to the bellows base during conveying movement of the separating bellows;

the cooling device comprises a cooling chamber extending circumferentially around the housing and extending in the axial direction to at least surround the extended length of the separating bellows; and wherein a bellows retainer is provided that comprises a protruding annular surface for the bellows base to rest on in at least one position of the bellows, the protruding annular surface comprising an indentation for residual fluid.

19. A conveying device, comprising a housing and a separating element which is arranged movably in the housing and separates two fluid regions in the housing from each other; wherein the separating element is formed of a separating bellows with individual bellows folds and a bellows base, the separating bellows moving in the axial direction from a contracted position to an extended position defining an extended length;

a mechanical actuating device is provided for controlling a movement of the separating bellows;

the conveying device comprising a cooling device; and the heat generated by the actuating device and the movement of the separating bellows is at least partially dissipated from the housing using a cooling device; wherein the actuating device comprises a drivable actuating rod which at least partially passes through the housing and can be brought into contact with the bellows base of the separating bellows for controlling a movement of the separating bellows;

the drivable actuating rod is separate from the bellows base and can selectively be held at a distance to the bellows base during conveying movement of the separating bellows;

the cooling device comprises a cooling chamber extending circumferentially around the housing and extending in the axial direction to at least surround the extended length of the separating bellows; and wherein the bellows are configured media-tight for conveying hydrogen gas at a pressure of at least 15 bar without particle contamination.

20. The conveying device of claim 1, wherein the bellows base of the separating bellows can be controlled on its side opposing the actuating rod by a fluid pressure which, penetrating a first of the two fluid regions, results in the separating bellows being extended and the actuating rod being moved back.

21. The conveying device of claim 20, wherein a fluid volume enclosed in a first of the two fluid regions remains the same or substantially the same when the separating bellows is extended by moving the actuating rod back out of the first fluid region.

22. The conveying device of claim 20, wherein a bellows retainer is arranged inside the housing in such a manner that, with the bellows base bearing on the bellows retainer, the bellows folds are stacked in a receiving space between the bellows retainer and the housing.

23. The conveying device of claim 20, wherein at least one fluid line is arranged in a bellows retainer, which fluid line opens into the first of the fluid regions.

* * * * *